United States Patent [19]

Murata

[11] 4,374,624

[45] Feb. 22, 1983

[54] SOUND EMITTING DEVICE FOR ELECTRONIC TIMEPIECE

[75] Inventor: Toshio Murata, Hoya, Japan

[73] Assignee: Citizen Watch Co., Ltd., Tokyo, Japan

[21] Appl. No.: 292,621

[22] Filed: Aug. 13, 1981

[30] Foreign Application Priority Data

Sep. 8, 1980 [JP] Japan ..... 55-127579
Dec. 17, 1980 [JP] Japan ..... 55-181544

[51] Int. Cl.[3] ..... G04C 21/00

[52] U.S. Cl. ..... 368/250; 368/88; 368/73

[58] Field of Search ..... 368/250, 255, 72, 73, 368/75, 88, 315; 340/387, 388

[56] References Cited

U.S. PATENT DOCUMENTS

| | | | |
|---|---|---|---|
| 2,722,681 | 11/1955 | Hersh | 340/388 |
| 3,004,153 | 8/1980 | Tiziant | 340/388 |
| 4,090,041 | 5/1978 | Mori et al. | 368/250 |
| 4,197,697 | 4/1980 | Mori et al. | 368/250 |

*Primary Examiner*—Bernard Roskoski
*Attorney, Agent, or Firm*—Koda and Androlia

[57] ABSTRACT

A sound emitting device for an electronic timepiece comprising a disk-shaped permanent magnet; a first yoke and second yoke introducing magnetic flux produced by the magnet and forming, outside the periphery of the magnet, a magnetic gap having the magnetic flux in the vertical direction of the perimeter of the magnet and in the horizontal direction of the disk surfaces of the magnet; a diaphragm carrying, within the magnetic flux of the magnetic gap, a moving coil wound at right angles to the magnetic flux and adapted to be vibrated in response to sound signal currents sent to the moving coil; and a support member supporting the permanent magnet, the yokes as well as the diaphragm at the diaphragm peripheral portion and removably secured at the support frame peripheral portion to a case. Air openings are provided in a part of the support member except where the permanent magnet, yokes and diaphragm are supported to form an air chamber which opens to the back of the diaphragm when the support member is packaged in the timepiece case.

15 Claims, 7 Drawing Figures

SOUND EMITTING DEVICE FOR ELECTRONIC TIMEPIECE

BACKGROUND OF THE INVENTION

This invention relates to a sound emitting device for an electronic timepiece and more particularly to a sound emitting device for an electronic timepiece which permits voices to tell the time and the like.

A conventional sound emitting device has been placed on the back side in a case so as to emit some sort of sound from small sound emitting perforations furnished in the case back, as shown in U.S. Pat. No. 4,206,590. Such a device emits the sound from little clearance between the user's wrist and the case back. As a result, the sound pressure drops, causing especially low-frequency sounds to be almost inaudible.

Another type of sound emitting device now available is placed on the upper side in the case to emit the sound from the top surface of the case. See, for example, U.S. Pat. Nos. 4,167,849, 4,180,970, 4,250,573 and so on. But all of the devices are only alarm buzzers. They have limited frequency response ranges and do not enable voices to tell the time.

Electronic timepieces telling the time with voices require a sound emitting device which permits a wide frequency range of sounds to be reproduced with sufficient sound pressure. To this end, a large diameter speaker is necessary. It is difficult, however, to contain a speaker assuring sufficient sound pressure and frequency characteristics into a compact electronic timepiece. In the past, no sound emitting device has satisfied such a requirement.

SUMMARY OF THE INVENTION

It is an object of the invention to provide a sound emitting device for an electronic timepiece which permits a wide frequency range of sounds to be reproduced when packaged in an electronic timepiece.

It is a further object of the invention to provide a sound emitting device for an electronic timepiece which is removably secured to a timepiece, particularly a watch.

It is another object of the invention to provide a sound emitting device for an electronic timepiece which is pressure- and water-resistant.

It is an additional object of the invention to provide an interconnecting member which is incorporated in a timepiece and conductive electrically while having a water-resistant function.

These objects of the present invention are achieved by the construction described hereinafter. According to the invention, a sound emitting device for an electronic timepiece includes a disk-shaped permanent magnet; at least one yoke introducing magnetic flux produced by the magnet and forming, outside the periphery of the magnet, a magnetic gap having the magnetic flux in the vertical direction of the perimeter of the magnet and in the horizontal direction of the disk-surfaces of the magnet; a diaphragm carrying, within the magnetic flux of the magnetic gap, a moving coil wound at right angles to the magnetic flux and adapted to be vibrated by the electromagnetic force received from the magnetic flux in response to variations in signal currents sent from a circuit block to the moving coil; and a support member supporting the permanent magnet and the yokes as well as the diaphragm at the diaphragm peripheral portion to a case, a plurality of openings being provided in a part of the support member except where the permanent magnet, yokes and diaphragm are supported, and the support member forming an air chamber which opens to the back of the diaphragm. Further, the surface of the support member opposite to the diaphragm is of the similar shape to the diaphragm. The diaphragm and the support member are bonded at each peripheral portion and held together as a unit, which is removably secured to the case by a fastening means such as a bayonet means engaging an annular recess formed inside the case.

DETAILED DESCRIPTION OF THE INVENTION

Referring now to the accompanying drawings, the embodiments of this invention will be discussed.

Figure 1:
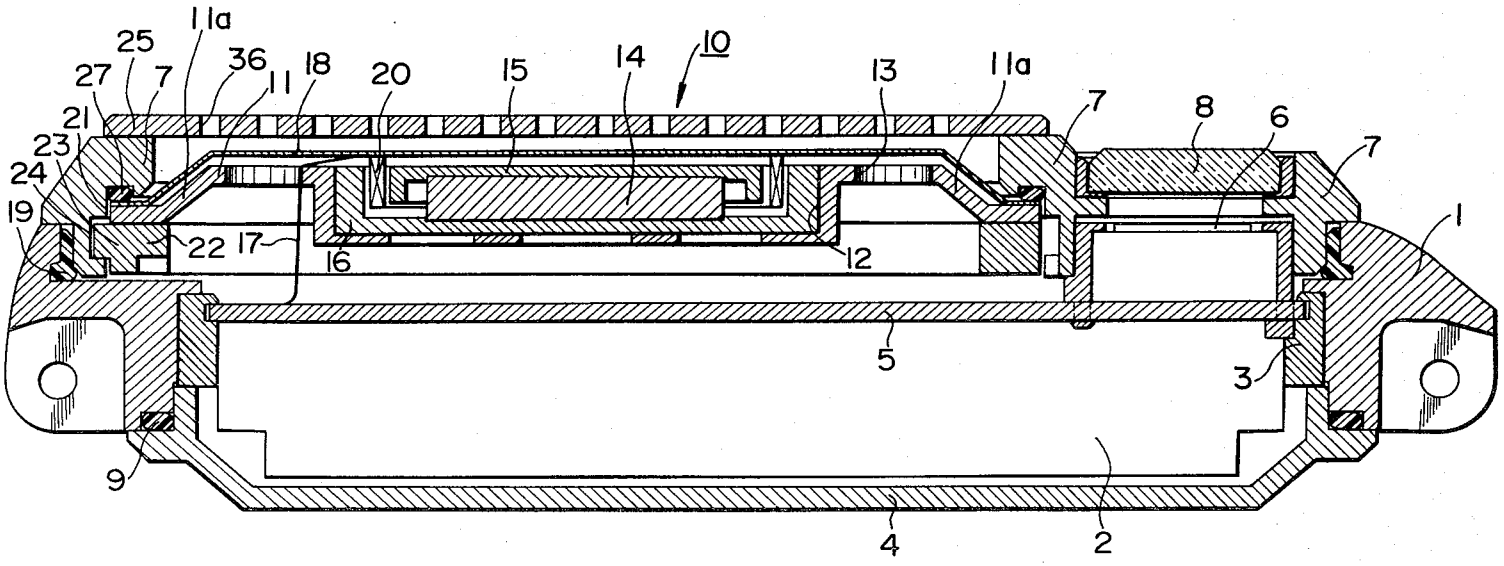
FIG. 1 is a sectional view of an electronic timepiece incorporating a sound emitting device in accordance with this invention.

In FIG. 1, within a case band 1 forming a part of a watch case, a circuit plate 5 is provided with a circuit block 2 at one side of the plate and a liquid crystal display panel 6 at the other side thereof, and a support frame 3 for supporting the plate 5 is locked by snapping a case back 4. A bezel 7 which forms a part of the case is fixed at the upper side of the case band 1 and a glass 8 for the liquid crystal display panel 6 is set in the bezel. Further, a sound emitting device 10 for an electronic timepiece of the present invention occupies the most part of the upper surface of the case.

Figure 2:
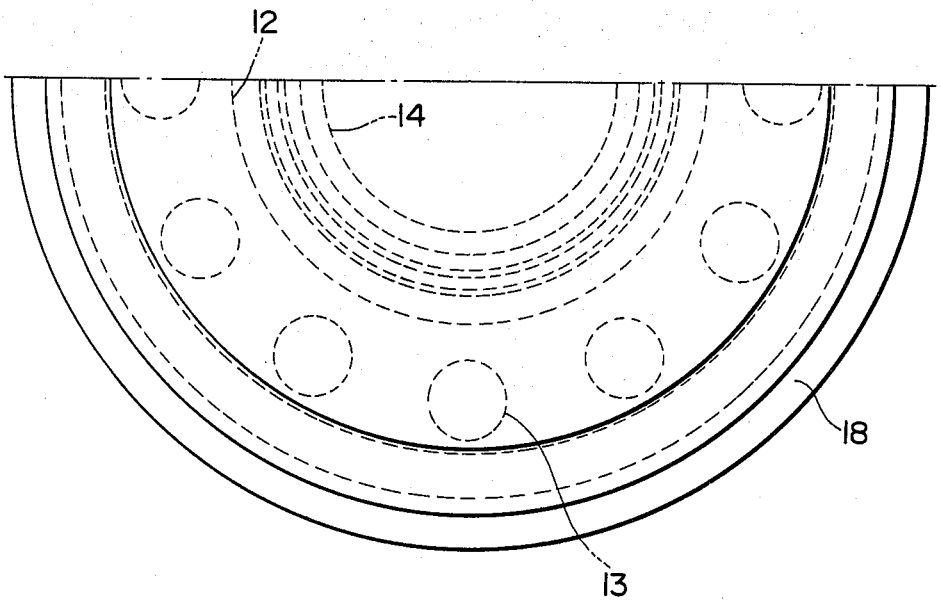
FIG. 2 is a front view of the sound emitting device shown in FIG. 1.

A sound emitting device support frame 11 is round in top plan view and comprises a slanted portion 11*a* to lift a middle portion, a recess 12 for holding a magnet 14 and yokes 15 and 16 on the middle of the case, and a lot of openings 13 around the circumference of the recess as shown in FIG. 2.

The permanent magnet 14 is shaped like a disk and is magnetized axially. At the upper side of the magnet, the cap-shaped first yoke 15 made of ferromagentic material is adhered, while at the lower side thereof, the cup-shaped second yoke 16 similarly made of ferromagnetic material and larger in diameter than the first yoke is adhered. In this way, the magnetic flux produced by the permanent magnet 14 forms a magnetic circuit to and from the magnet 14 through the first yoke 15 and second yoke 16, thereby forming a magnetic gap having the magnetic flux in a direction radial from the outside of the cylindrical surface of the first yoke 15 to the opposite inside surface of the second yoke 16 (in a direction vertical to the perimeter of the first yoke) and in a direction parallel to the disk surfaces of the magnet 14. Such a magnetic block is locked in the recess 12 formed in the support frame 11 and the second yoke 16 is adhered to the inner wall of the recess 12. Over the frame 11, a diaphragm 18 which carries a moving coil 20 wound at the right angles to the magnetic flux in the magnetic gap is disposed and is adapted to be vibrated by the electromagnetic force produced by the magnetic flux in response to variations in sound signal currents sent to the moving coil. The diaphragm 18 is made of a thin resin plate and shaped along the support frame 11. The cylindrical moving coil 20 is secured to the back side of the diaphragm by bonding, welding, ultrasonic welding or the like. The diaphragm 18 is adhered at its peripheral edge to the peripheral edge of the support frame 11. As stated above, the moving coil 20 is disposed in the magnetic gap of the first and second yokes 15 and 16. Thus, the magnet 14, yokes 15 and 16, moving coil 20, diaphragm 18 and support frame 11 are held together to form a single unit of the sound emitting device for an electronic timepiece.

The sound emitting device forming a unit engages in an annular recess 21 formed inside the bezel 7 and is removably secured to the bezel 7 by turning a bayonet 22 in such a manner that a protrusion 23 of the bayonet may engage a slot 24 cut in the recess 21. As well as the bayonet, any suitable means such as a screw, O ring, retaining ring E type, snap fitting and the like is available for securing removably the unit. A net plate or perforated guard plate 25 is attached to the upper surface of the bezel by means of screws.

The construction mentioned above permits the diaphragm 18 to vibrate over a wide frequency range in response to sound signal currents sent from the circuit block 2 to the moving coil 20 to tell the time and the like.

As is clear from FIGS. 1 and 2, the back of the diaphragm 18 is connected to a relatively large-sized air chamber through openings 13 in the support frame 11. If a large diameter speaker is packaged in a timepiece, the minimum resonance frequency ($f_0$) will become too high to reproduce sounds. To prevent this, the above construction is designed to minimize the equivalent stiffness, thereby rendering the minimum resonance frequency of the speaker lower so as to provide a flat frequency characteristic.

Also, as shown in FIG. 1, the support frame 11 has an opposite surface spaced at a predetermined distance from the diaphragm 18 at the periphery of a part where the magnet 14 and the yokes 15 and 16 are held. The opposite surface is of the similar shape to the diaphragm. Thus, even if any external shock by dropping or external pressure such as hydraulic pressure from sound emitting perforations 36 in the guard plate 25 is applied, the diaphragm 18 will strike the support frame 11 at a slight distortion, thus maintaining its original state. If the support frame 11 is designed to have the strength enough to resist external pressure, it is hardly deformed after the diaphragm 18 strikes it, and therefore any deformation, distortion, or cracking does not appear on the diaphragm 18 after recovering the original condition where the external shock and pressure are removed.

As described above, the diaphragm 18, moving coil 20, magnet 14, yokes 15 and 16 and support frame 11 are assembled as one unit for ease of assembly. This unit is removably secured to the bezel 7 which is fixed to the case band 1, thus facilitating the replacement and cleaning without removing the circuit block 2 from the case band 1.

Moreover, the diaphragm 18 is made of resin and an O ring 27 is interposed between the bezel 7 and the diaphragm 18, thus preventing moisture which entered from the guard plate 25 on the bezel 7 from entering the inside of the timepiece.

Figure 3:
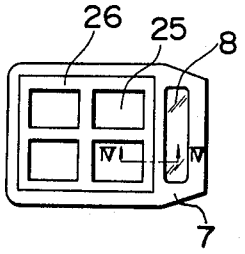
FIG. 3 is a front view illustrating another embodiment of an electronic timepiece incorporating a sound emitting device in accordance with this invention.
Figure 4:
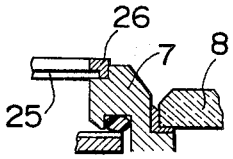
FIG. 4 is a partially sectional view of FIG. 3.

In FIGS. 3 and 4, there is shown another embodiment in which a sound emitting device is square in top plan view and a lattice type sound emitting device guard frame 26 is lodged thereon to improve the shock resistance of the guard plate 25.

Figure 5:
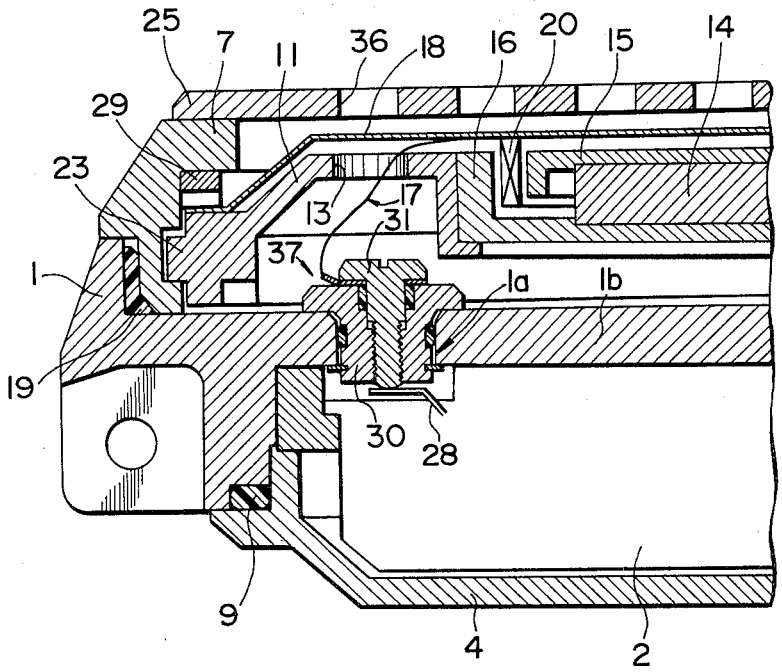
FIG. 5 is a sectional view of a further embodiment of an electronic timepiece incorporating a sound emitting device in accordance with the invention.

FIG. 5 shows a further embodiment in accordance with the invention in which the sound emitting perforations 36 are increased in size in order to enhance sound emitting effects. In the same drawing, case band 1 has a wall **1*b* so as to divide the interior of the case into upper and lower compartments. The circuit block 2 is contained in the lower compartment of the wall 1*b* to which the case back is snapped, assuring water-resistance by use of an O ring 9. Drilled through the wall 1*b* is an opening 1*a*, into which an interconnecting member 37 (FIG. 6) is inserted and locked. One end of the interconnecting member 37 touches a contact spring 28 attached to the circuit block 2, while the other end of the member 37 is connected to a lead 17. The lead is connected to the moving coil 20**.

The support frame 11 is fastened with the bayonet to the bezel 7 by means of the protrusion 23 integrally formed at the frame peripheral portion. On the upper surface in the vicinity of the peripheries of the support frame 11 and the diaphragm 18, a corrugated spring 29 is loaded in place to receive the bayonet-fitting force. The bezel 7 and the case band 1 are forcedly fit through an elastic member 19.

Figure 6:
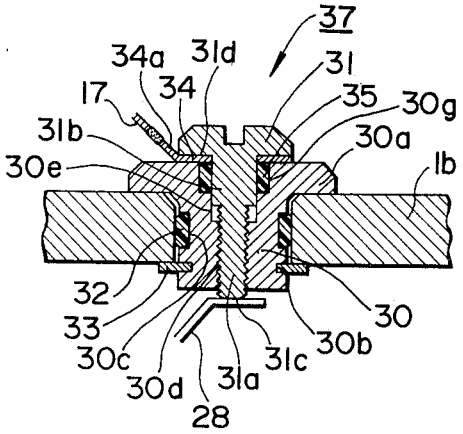
FIG. 6 is a partially detailed view of FIG. 5.

FIG. 6 is a detailed view of the interconnecting member 37 shown in FIG. 5.

In FIG. 6, the interconnecting member 37 comprises a resin pipe 30 and a metal screw 31. For electric insulation, the resin pipe 30 is inserted into the opening **1*a* formed in the dividing wall 1*b* of the case band. The pipe 30 has a flange 30*a* at the upper end and peripheral grooves 30*b* and 30*c* respectively near the opposite lower end and near the middle of the pipe in the longitudinal direction. The pipe is inserted into the opening with a water-resistant O ring 32 placed in a groove 30*d* and the resin pipe 30 is fixed in the dividing wall 1*b* by means of a ring 33 in the groove 30*b* and the flange 30*a*. The inner diameter of the pipe 30 is formed with two steps; a large inner diameter portion 30*e* and a small inner diameter portion which has the threaded portion 30*d*. A groove 30*g* for loading an O ring 35 is cut in the upper end of the large inner diameter portion 30*e*. Also, the screw 31 has an outer diameter comprising two steps; a large outer diameter portion 31*b* and a small outer diameter portion 31*a*. The small outer diameter portion 31*a* which mates with the threaded portion 30*d* of the pipe 30 is formed with threaded and screwed fixedly into the inner circumference of the pipe 30 with a washer 34 and the water-resistant O ring 35 placed. The O ring 35 is loaded in clearance formed between the large inner diameter portion 30*e* of the pipe 30 and the large outer diameter portion 31*b* of the screw 31 to keep water-resistance. A lower portion 31*c* of the screw 31** serves as a contact for electric conduction.

Figure 7:
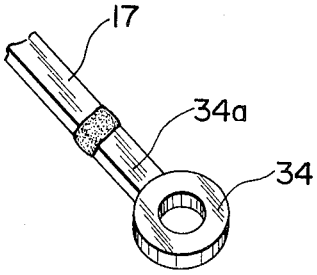
FIG. 7 is a perspective view of a portion of the washer shown in FIG. 6.

The washer 34 is shaped as shown in FIG. 7 and protrudes a tongue **34*a* from a part of its periphery. A lead 17 is connected to the tongue 34*a* by soldering or the like, whereby electric connections are made with the large diameter portion 31***b* of the screw 31 through the lead 17 and washer 34.

As described above, the sound emitting device in accordance with the invention permits a wide frequency range of sounds to be reproduced when packaged in an electronic timepiece. This device constitutes a single unit and can removably be secured to the timepiece, facilitating the replacement, cleaning and the like and providing sufficient pressure- and water-resistance. The present invention satisfies the conditions for a sound emitting device for an electronic timepiece.

What is claimed is:

1. A sound emitting device for an electronic timepiece comprising:

a disk-shaped permanent magnet;

at least one yoke introducing magnetic flux produced by said magnet and forming, outside the periphery of said magnet, a magnetic gap having the magnetic flux in the vertical direction of the perimeter of said magnet and in the horizontal direction of the disk surfaces of said magnet;

a diaphragm carrying, within the magnetic flux of the magnetic gap, a moving coil wound at right angles to said magnetic flux and adapted to be vibrated by the electromagnetic force received from said magnetic flux in response to variations in signal currents sent from a circuit block to said coil; and a support member supporting said permanent magnet and said yoke as well as said diaphragm at the diaphragm peripheral portion and to be secured removably at the support member peripheral portion to a timepiece case, a plurality of openings being provided in a part of said support member except where said permanent magnet, yoke and diaphragm are supported, and said support member forming an air chamber which opens to the back of the diaphragm, when the support member is packaged in the timepiece case.

2. The sound emitting device as in claim 1 wherein said at least one yoke comprises a cap-shaped first yoke and a cup-shaped second yoke, said magnetic gap being provided between said first yoke and said second yoke for locating said moving coil.

3. The sound emitting device as in claim 2 wherein said support member has an opposite surface in the vicinity of a part where said magnet, first and second yokes are supported, said opposite surface being of the similar shape to the diaphragm and spaced at a predetermined distance from said diaphragm, whereby the support member is constructed so as to serve as a deformation preventing member for the diaphragm.

4. The sound emitting device as in claim 1, 2 or 3 wherein said diaphragm is made of a thin resin plate and adhered at its peripheral edge to the peripheral edge of said support member.

5. An electronic timepiece comprising:

a disk-shaped permanent magnet;

at least one yoke introducing magnetic flux produced by said magnet and forming, outside the periphery of said magnet, a magnetic gap having the magnetic flux in the vertical direction of the perimeter of said magnet and in the horizontal direction of the disk surfaces of said magnet;

a diaphragm carrying, within the magnetic flux of the magnetic gap, a moving coil wound at right angles to said flux and adapted to be vibrated by the electromagnetic force received from said magnetic flux in response to variations in signal currents sent from a circuit block to said coil;

a support member supporting said permanent magnet and said yoke as well as said diaphragm at the diaphragm peripheral portion and secured removably at the support member peripheral portion to a timepiece case, a plurality of openings being provided in a part of said support member except where said permanent magnet, yoke and diaphragm are supported, and said support member forming an air chamber which opens to the back of said diaphragm;

a means for securing removably said support member to the case;

a circuit means sending the signal currents to the moving coil; and a guard member locked on the surface of the case.

6. The electronic timepiece as in claim 5 wherein said at least one yoke comprises a cap-shaped first yoke and a cup-shaped second yoke, said magnetic gap being provided between said first yoke and said second yoke for locating said moving coil.

7. The electronic timepiece as in claim 6 wherein said support member has an opposite surface in the vicinity of a part where said magnet, first yoke and second yoke are supported, the opposite surface being of the similar shape to the diaphragm and separated at a predetermined distance from the diaphragm, whereby the support member is constructed so as to serve as a deformation preventing member for the diaphragm.

8. The electronic timepiece as in claim 7 wherein said diaphragm is made of a thin resin plate and secured at its peripheral portion to the periphery of said support member.

9. The electronic timepiece as in any one of claims 5 to 8 wherein said securing means comprises an annular recess formed inside the case and a bayonet means engaging said recess.

10. The electronic timepiece as in any one of claims 5 to 8 wherein said securing means comprises an annular recess formed inside the bezel and a bayonet means engaging said recess.

11. The electronic timepiece as in any one of claims 5 to 8 wherein said bayonet means is integral with the periphery of said support member.

12. The electronic timepiece as in any one of claims 5 to 8 wherein said bayonet means is integral with the periphery of said support member.

13. The electronic timepiece as in claim 5 wherein said case has a wall to divide the inside to upper and lower compartments, said wall comprising an interconnecting member for an electric connection with the upper and lower compartments.

14. The electronic timepiece as in claim 13 wherein said interconnecting member comprises an insulating pipe inserted and locked in an opening formed through the dividing wall, a conductive screw screwed into said pipe, and two contactors, said pipe being locked axially by means of a flange and a retaining ring provided at the opposite ends of the pipe and being sealed with an O ring placed at the periphery of the pipe, one of the contactors being locked by means of the pipe and the screw, the other of the contactors being abutting against the end of the screw, and further an O ring being loaded between the pipe and the screw, whereby electric connections are made between the non water-resistant compartment and the water-resistant compartment divided by the wall within the case while the water-resistance is kept.

15. The electronic timepiece as in claim 5 wherein a sound emitting device guard frame is provided on said guard member.

* * * * *